US009115906B2

(12) United States Patent
Kanazawa

(10) Patent No.: US 9,115,906 B2
(45) Date of Patent: Aug. 25, 2015

(54) AIR BLOWING DEVICE

(71) Applicant: Sharp Kabushiki Kaisha, Osaka-shi, Osaka (JP)

(72) Inventor: Yukimasa Kanazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/386,053

(22) PCT Filed: Apr. 3, 2013

(86) PCT No.: PCT/JP2013/060166

§ 371 (c)(1),
(2) Date: Sep. 18, 2014

(87) PCT Pub. No.: WO2013/154000

PCT Pub. Date: Oct. 17, 2013

(65) Prior Publication Data

US 2015/0108363 A1 Apr. 23, 2015

(30) Foreign Application Priority Data

Apr. 9, 2012 (JP) ..... 2012-088726
Apr. 9, 2012 (JP) ..... 2012-088727

(51) Int. Cl.
*F04D 25/08* (2006.01)
*F04D 29/05* (2006.01)
(Continued)

(52) U.S. Cl.
CPC ..... *F24F 3/16* (2013.01); *F04D 19/002* (2013.01); *F04D 25/06* (2013.01); *F04D 25/08* (2013.01); *F04D 29/005* (2013.01); *F24F 2003/1682* (2013.01)

(58) Field of Classification Search
CPC ..... F04D 25/08; H01T 23/00; A61L 9/22
USPC ..... 250/423 R, 424
See application file for complete search history.

(56) References Cited

U.S. PATENT DOCUMENTS 2,873,908 A * 2/1959 Powers ..... 415/211.2
5,304,040 A * 4/1994 Wang ..... 416/247 R
(Continued)

FOREIGN PATENT DOCUMENTS

CN 201880072 U * 6/2011
JP 49-027550 U 3/1974
(Continued)

OTHER PUBLICATIONS

Official Communication issued in International Patent Application No. PCT/JP2013/060166, mailed on Jul. 9, 2013.

*Primary Examiner* — David A Vanore
(74) *Attorney, Agent, or Firm* — Keating & Bennett, LLP

(57) ABSTRACT

There is provided an air blowing device that is easy to carry and is convenient, the air blowing device that has little adverse effect on the blowing function and is configured to be able to disperse electrically-charged particles while ensuring safety.

A fan 4 coupled to an output shaft 33*a* of a motor 33 is rotated by the motor 33 to send air. The motor 33 is housed in a motor housing portion 3, and a fan cover rear separate body 72 in the shape of a flange, the fan cover rear separate body 72 covering an outer edge portion of the fan 4 and a lateral part of the fan 4 on the side where the motor 33 is located, is fixed to an end of the motor housing portion 3 on the side where the output shaft 33*a* is located. A handle portion 2 is provided in a standing manner in an intermediate portion of the output shaft 33*a* in a direction of an axis thereof on an outer surface of the motor housing portion 3, and the fan cover rear separate body 72 has a tapered portion T which faces the handle portion 2 and whose outer peripheral side is inclined toward the fan 4. A passage 25 that allows air to pass therethrough is provided in an intermediate portion of the handle portion 2, and an ion generator 9 that generates positive and negative ions to be released into the passage 25 is provided in the handle portion 2 in a base end portion thereof.

14 Claims, 7 Drawing Sheets

(51) Int. Cl.

| | |
|---|---|
| ***F24F 3/16*** | (2006.01) |
| ***F04D 29/00*** | (2006.01) |
| ***F04D 19/00*** | (2006.01) |
| ***F04D 25/06*** | (2006.01) |

(56) References Cited

U.S. PATENT DOCUMENTS

| | | | | |
|---|---|---|---|---|
| 5,612,849 | A * | 3/1997 | Prehodka et al. | 361/213 |
| 6,176,977 | B1 * | 1/2001 | Taylor et al. | 204/176 |
| 6,393,718 | B1 * | 5/2002 | Harris et al. | 34/96 |
| 6,398,852 | B1 * | 6/2002 | Loreth | 96/63 |
| 2002/0094298 | A1 * | 7/2002 | Monagan | 422/5 |
| 2002/0146356 | A1 * | 10/2002 | Sinaiko et al. | 422/186.04 |
| 2004/0047743 | A1 * | 3/2004 | Dooley et al. | 417/234 |
| 2004/0088817 | A1 * | 5/2004 | Cochran et al. | 15/327.5 |
| 2004/0234431 | A1 * | 11/2004 | Taylor et al. | 422/186.04 |
| 2005/0055795 | A1 * | 3/2005 | Zeiler et al. | 15/353 |
| 2006/0016336 | A1 * | 1/2006 | Taylor et al. | 96/25 |
| 2006/0018808 | A1 * | 1/2006 | Taylor et al. | 422/186.04 |
| 2006/0018810 | A1 * | 1/2006 | Taylor et al. | 422/186.04 |
| 2006/0018811 | A1 * | 1/2006 | Taylor et al. | 422/186.04 |
| 2006/0159594 | A1 * | 7/2006 | Parker et al. | 422/121 |
| 2006/0203416 | A1 * | 9/2006 | Taylor et al. | 361/230 |
| 2006/0227491 | A1 * | 10/2006 | Rosati et al. | 361/229 |
| 2007/0148061 | A1 * | 6/2007 | Lau et al. | 422/186.04 |
| 2009/0078800 | A1 * | 3/2009 | Nakasone et al. | 239/690 |
| 2009/0211052 | A1 * | 8/2009 | Ninomiya et al. | 15/339 |
| 2011/0030560 | A1 * | 2/2011 | Bohlen et al. | 96/57 |
| 2011/0223016 | A1 * | 9/2011 | Ediger et al. | 415/213.1 |
| 2013/0028763 | A1 * | 1/2013 | Staniforth et al. | 417/423.5 |
| 2014/0060565 | A1 * | 3/2014 | Saito | 132/200 |

FOREIGN PATENT DOCUMENTS

| | | | | |
|---|---|---|---|---|
| JP | 59-085399 | U | 6/1984 | |
| JP | 06-147188 | A | 5/1994 | |
| JP | 07-077194 | A | 3/1995 | |
| JP | 09-245935 | A | 9/1997 | |
| JP | 2005-233013 | A | 9/2005 | |
| JP | 2005233013 | A * | 9/2005 | F04D 25/08 |
| JP | 2009-264139 | A | 11/2009 | |
| JP | 2011045563 | A * | 3/2011 | |
| JP | 2012255389 | A * | 12/2012 | |
| JP | 2013217293 | A * | 10/2013 | |
| WO | WO 2005082486 | * | 9/2005 | |
| WO | WO 2012169216 | * | 12/2012 | |

* cited by examiner

AIR BLOWING DEVICE

TECHNICAL FIELD

The present invention relates to air blowing devices that blow the sucked air and, in particular, to an air blowing device that is configured to be able to disperse electrically-charged particles to purify air.

BACKGROUND ART

In the past, in air blowing devices such as an electric fan, air blowing devices having various functions in addition to the blowing function of sending air with a desired flow rate and in a desired direction have been proposed.

An air blowing device disclosed in PTL 1 has a structure in which a negative ion generator generating negative ions which are electrically-charged particles is simply attached to the air blowing device. For example, by providing, near an impeller (a fan) of an electric fan which is the air blowing device and is easy to carry, the negative ion generator in front of or behind the electric fan, it is possible to feel cool air with ease and, at the same time, obtain the useful physiological effect such as refreshing feeling by the negative ions.

Moreover, as a method for generating electrically-charged particles, a method for generating positive and negative ions produced as a result of water molecules such as $H^+(H_2O)m$ and $O_2^-(H_2O)_n$ being flocculated by performing discharge in the air has been known. Here, m and n are arbitrary natural numbers. As another method for generating electrically-charged particles, there is, for example, a method for generating electrically-charged misty water particles (hereinafter written as electrically-charged water particles) by applying a high voltage to water collected on a cooled electrode by condensation or the like. The ions produced as a result of water molecules being flocculated and the electrically-charged particles such as electrically-charged water particles have the effect of purifying air such as inactivating bacteria in the air.

Furthermore, in PTL 2, an existing air blowing device is disclosed. The air blowing device is formed of a motor housing portion that houses a motor, a fan that is coupled to an output shaft of the motor and sends air in a shaft length direction by rotating, a fan cover that covers the fan, and so forth. The motor housing portion has the shape of a closed-end cylinder and has one end face from which the output shaft of the motor protrudes. The fan is coupled to the output shaft protruding from the motor housing portion. The fan cover is fixed to one end face of the motor housing portion with a nut or the like. The motor housing portion is supported by a supporting column provided in a standing manner in a base placed on a floor surface. To the fan cover, a handle portion is attached.

Moreover, in PTL 3, a handle portion formed of a metal wire is attached to a fan cover of an air blowing device, and the user can carry the air blowing device by grasping and lifting the handle portion by inserting a fingertip into the space between the handle portion and the fan cover.

CITATION LIST

Patent Literature

PTL 1: Japanese Unexamined Patent Application Publication No. 09-245935

PTL 2: Japanese Unexamined Patent Application Publication No. 07-077194

PTL 3: Japanese Unexamined Patent Application Publication No. 2009-264139

SUMMARY OF INVENTION

Technical Problem

However, since, in the existing air blowing device described in PTL 1, the negative ion generator generates negative ions by causing discharge by applying a negative high voltage to a discharge electrode, when the negative ion generator is attached to the outer surface of the air blowing device, there is a possibility that babies and toddlers, for example, touch the negative ion generator, which causes safety issues. Moreover, when the negative ion generator is placed in front of the impeller, the sent airflow is disturbed depending on the outside shape of the negative ion generator, which affects the blowing function.

Moreover, in the existing air blowing devices described in PTL 2 and PTL 3, although the handle portion that is used at the time of transportation is formed, when the air blowing device is swayed back and forth during transportation, it is impossible to grasp the handle portion firmly against the sway, and the air blowing device sways and becomes unstable. In actuality, if the handle portion is formed of a metal wire as described in PTL 3, the metal wire rotates in the hand, making it difficult to grasp the air blowing device in such a way that the air blowing device does not sway.

In order to make it possible to grasp the handle portion against the moment that is generated by the sway of the air blowing device, a structure in which the outside shape of the handle portion is increased by coupling a rod member for grip with a section size of about 10 to 30 mm square to the handle portion to the metal wire with an adhesive or the like may be adopted. However, in this structure, there is a possibility that a heavy load is imposed on a coupling portion and the rod member comes off the metal wire, which makes it difficult to obtain a desired result.

Thus, a structure in which a handle portion with a section size of about 10 to 30 mm square is coupled to a cylindrical side face of a motor housing portion may be adopted. For example, by forming a handle portion and a cylindrical motor housing portion as one piece or fastening a handle portion with a mounting flange as a separate body to a cylindrical side face of a motor housing portion with a fastening member, sufficient coupling strength between the handle portion and the motor housing portion can be secured.

However, when a handle portion with a section size of about 10 to 30 mm square is placed in exactly the same position in order to replace the handle portion provided in the above-described fan cover (the handle portion described in PTL 2), the space between the fan cover and the handle portion is narrowed by an amount equal to an increase in the outside shape of the handle portion, which makes it difficult to insert the fingertip thereinto. Moreover, when the fingertip is slightly moved to grasp the handle portion against the sway of the air blowing device while the air blowing device is being carried, if the space between the fan cover and the handle portion is narrow, the fan cover unfavorably interferes with the moved fingertip.

The present invention has been made in view of the circumstances described above, and an object thereof is to provide an air blowing device that is easy to carry and is convenient, the air blowing device that has little adverse effect on the blowing function and is configured to be able to disperse electrically-charged particles while ensuring safety.

Solution to Problem

An air blowing device according to the present invention is directed to an air blowing device that sends air by an impeller coupled to an output shaft of a motor, the air blowing device including: a motor housing portion that houses the motor; an impeller cover that is fixed to the motor housing portion and has the shape of a flange, the impeller cover covering an outer edge portion of the impeller and a lateral part of the impeller on the side where the motor is located; and a handle portion that is provided in a standing manner in an intermediate portion on an outer surface of the motor housing portion in the output shaft direction, wherein the impeller cover has a tapered portion which faces the handle portion and whose outer peripheral side is inclined toward the impeller.

In the present invention, the impeller coupled to the output shaft of the motor is rotated by the motor to send air. The motor is housed in the motor housing portion, and the impeller cover in the shape of a flange, the impeller cover covering the outer edge portion of the impeller and the lateral part of the impeller on the side where the motor is located, is fixed. The handle portion is provided in a standing manner in the intermediate portion on the outer surface of the motor housing portion in the output shaft direction. Since the impeller cover has the tapered portion which faces the handle portion and whose outer peripheral side is inclined toward the impeller, an adequate space between the handle portion and the impeller cover is secured, which makes it easy to hold the handle portion and carry the air blowing device.

The air blowing device according to the present invention is characterized in that the impeller cover has a fitting portion fitting into the motor housing portion.

In the present invention, since the impeller cover has the fitting portion fitting into the motor housing portion, when the impeller cover is attached to the motor housing portion, by fitting the fitting portion into the motor housing portion, the radial position is determined, which facilitates assembly.

The air blowing device according to the present invention is characterized in that the impeller cover is in contact with the handle portion.

In the present invention, since the impeller cover is in contact with the handle portion and the impeller cover is biased and supported by the handle portion, the shake of the impeller cover caused by the vibration which is generated when the impeller is rotated by the motor is suppressed.

The air blowing device according to the present invention is characterized in that the handle portion has, in an intermediate portion, a passage that allows air to pass therethrough and the air blowing device includes an electrically-charged particle generator that generates electrically-charged particles which are released into the passage.

In the present invention, the handle portion has, in the intermediate portion, the passage that allows the air to pass therethrough, and electrically-charged particles which are released into the passage are generated by the electrically-charged particle generator. The electrically-charged particles are sucked in by the impeller with the air passing through the passage and are blown out therefrom. The air is purified by the electrically-charged particles blown out from the impeller.

The air blowing device according to the present invention is characterized in that a breathable cover is disposed in an opening of the passage and the electrically-charged particle generator has a discharge electrode exposed in the passage and an induction electrode which faces the discharge electrode and to which a high voltage is applied between the induction electrode and the discharge electrode.

In the present invention, the breathable cover is disposed in the opening of the passage, and the electrically-charged particle generator has the discharge electrode exposed in the passage and the induction electrode which faces the discharge electrode and to which a high voltage is applied between the induction electrode and the discharge electrode. Since the discharge electrode is exposed in the passage, the electrically-charged particles generated near the discharge electrode are easily carried by the airflow in the passage, making it possible to disperse the electrically-charged particles more effectively. Since the air cover is disposed in the opening of the passage, even when the discharge electrode to which a high voltage is applied between the discharge electrode and the induction electrode is exposed in the passage, the discharge electrode is prevented from being touched from outside.

The air blowing device according to the present invention is characterized in that the handle portion is formed of two separate bodies that overlap in an intermediate portion in the output shaft direction and the electrically-charged particle generator is sandwiched between the two separate bodies.

In the present invention, since the handle portion is formed of the two separate bodies that overlap in the intermediate portion in the output shaft direction and the electrically-charged particle generator is sandwiched between the two separate bodies, it is easy to attach the electrically-charged particle generator.

The air blowing device according to the present invention is characterized in that the handle portion is formed integrally with the motor housing portion.

In the present invention, since the handle portion is formed integrally with the motor housing portion, the coupling between the handle portion and the motor housing portion is strengthened and the number of parts and the number of assembly processes are reduced, which facilitates production.

The air blowing device according to the present invention is characterized in that the handle portion is disposed in a lateral nearly-barycentric position of an air blowing device main body with the motor housing portion coupled to an upper part of a supporting column provided in a standing manner in a base to be placed on a floor surface.

In the present invention, the air blowing device main body is configured with the motor housing portion coupled to the upper part of the supporting column provided in a standing manner in the base to be placed on the floor surface, and the handle portion is disposed in the lateral nearly-barycentric position of the air blowing device main body. As a result, when a state in which the air blowing device main body is put on the floor surface is changed to a state in which the air blowing device main body is lifted with the handle portion being grasped, the position of the air blowing device main body is not changed, which makes it easy to carry the air blowing device main body.

The air blowing device according to the present invention is directed to an air blowing device that sends air by an impeller coupled to an output shaft of a motor, the air blowing device including: a motor housing portion that houses the motor; a handle portion provided in a standing manner on an outer surface of the motor housing portion, the handle portion having, in an intermediate portion, a passage that allows air to pass therethrough; and an electrically-charged particle generator that is provided in the handle portion in the base end portion thereof and generates electrically-charged particles which are released into the passage.

In the present invention, the impeller coupled to the output shaft of the motor is rotated by the motor to send air. The motor is housed in the motor housing portion, and the handle portion is provided in a standing manner on the outer surface of the motor housing portion. Since the passage that allows the air to pass therethrough is provided in the intermediate portion of the handle portion and the electrically-charged particle generator that generates the electrically-charged particles which are released into the passage is provided in the handle portion in the base end portion thereof, the electrically-charged particle generator is prevented from being touched from outside. Moreover, when the impeller sends air to a direction opposite to the direction in which the motor housing portion is located, since the handle portion is located on the side opposite to the direction in which the impeller sends air, the effect of the impeller on the blowing function is suppressed.

The air blowing device according to the present invention is characterized in that a breathable cover is disposed in an opening of the passage and the electrically-charged particle generator has a discharge electrode exposed in the passage and an induction electrode which faces the discharge electrode and to which a high voltage is applied between the induction electrode and the discharge electrode.

In the present invention, the breathable cover is disposed in the opening of the passage, and the electrically-charged particle generator has the discharge electrode exposed in the passage and the induction electrode which faces the discharge electrode and to which a high voltage is applied between the induction electrode and the discharge electrode. Since the discharge electrode is exposed in the passage, the electrically-charged particles generated near the discharge electrode are easily carried by the airflow in the passage, making it possible to disperse the electrically-charged particles more effectively. Since the air cover is disposed in the opening of the passage, even when the discharge electrode to which a high voltage is applied between the discharge electrode and the induction electrode is exposed in the passage, the discharge electrode is prevented from being touched from outside.

The air blowing device according to the present invention is characterized in that the handle portion is formed of two separate bodies that overlap in an intermediate portion in the output shaft direction and the electrically-charged particle generator is sandwiched between the two separate bodies.

In the present invention, since the handle portion is formed of the two separate bodies that overlap in the intermediate portion in the output shaft direction and the electrically-charged particle generator is sandwiched between the two separate bodies, it is easy to attach the electrically-charged particle generator.

The air blowing device according to the present invention is characterized in that the motor housing portion has the shape of a cylinder whose axial direction coincides with the direction of an axis of the output shaft.

In the present invention, since the motor housing portion has the shape of a cylinder whose axial direction coincides with the direction of an axis of the output shaft, the airflow of the air blowing device is stabilized.

The air blowing device according to the present invention is characterized in that the passage is provided in such a way as to pass through the handle portion in the direction of an axis of the output shaft.

In the present invention, since the passage passes through the handle portion in the direction of an axis of the output shaft, the electrically-charged particles are easily carried by the airflow in the passage.

The air blowing device according to the present invention is characterized in that the handle portion has, at the tip thereof, a horizontally long hand insertion hole passing through the handle portion in the direction of an axis of the output shaft.

In the present invention, the horizontally long hand insertion hole passing through the handle portion in the direction of an axis of the output shaft is provided at the tip of the handle portion, which facilitates transportation.

Advantageous Effects of Invention

According to the present invention, an impeller coupled to an output shaft of a motor is rotated by the motor to send air. The motor is housed in a motor housing portion, and an impeller cover in the shape of a flange, the impeller cover covering an outer edge portion of the impeller and a lateral part of the impeller on the side where the motor is located, is fixed. The handle portion is provided in a standing manner in an intermediate portion on an outer surface of the motor housing portion in the output shaft direction. The impeller cover has a tapered portion which faces the handle portion and whose outer peripheral side is inclined toward the impeller. As a result, an adequate space between the handle portion and the impeller cover is secured, which makes it easy to hold the handle portion and carry the air blowing device and thereby makes it possible to enhance the convenience.

DESCRIPTION OF EMBODIMENTS

Figure 1:
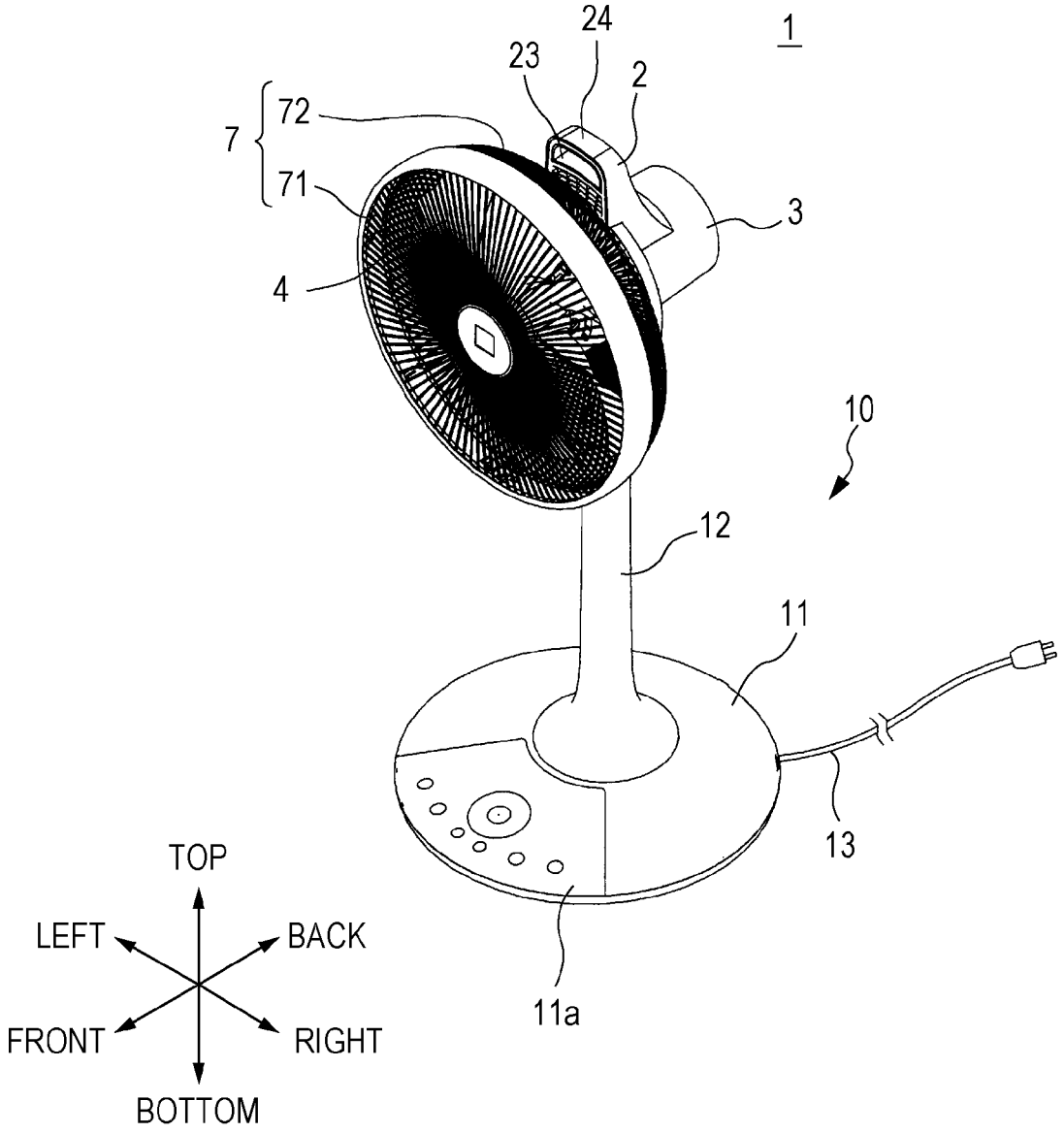
FIG. 1 is a perspective view depicting the front-side appearance of an electric fan according to an embodiment.
Figure 2:
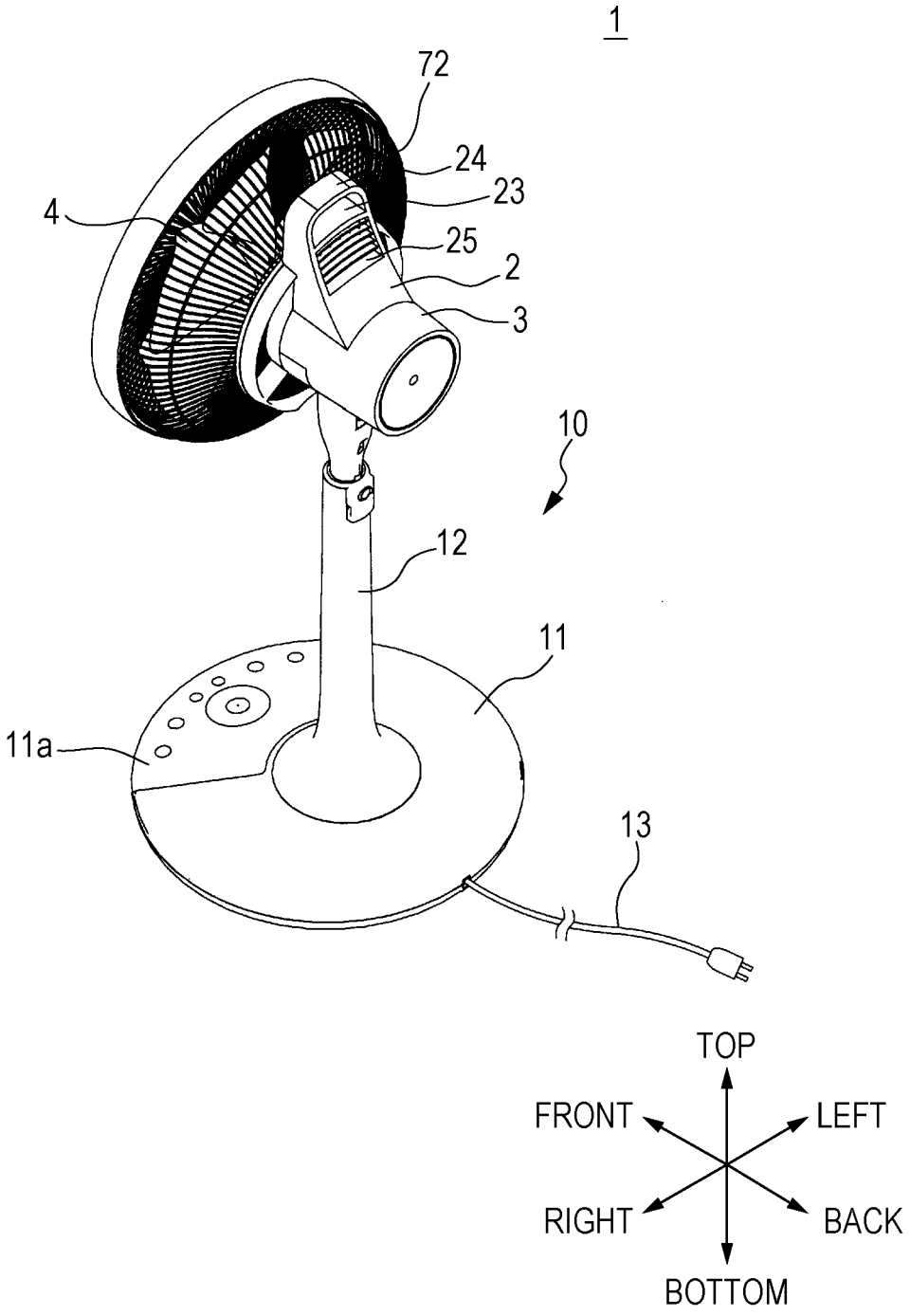
FIG. 2 is a perspective view depicting the back-side appearance of the electric fan according to the embodiment.
Figure 3:
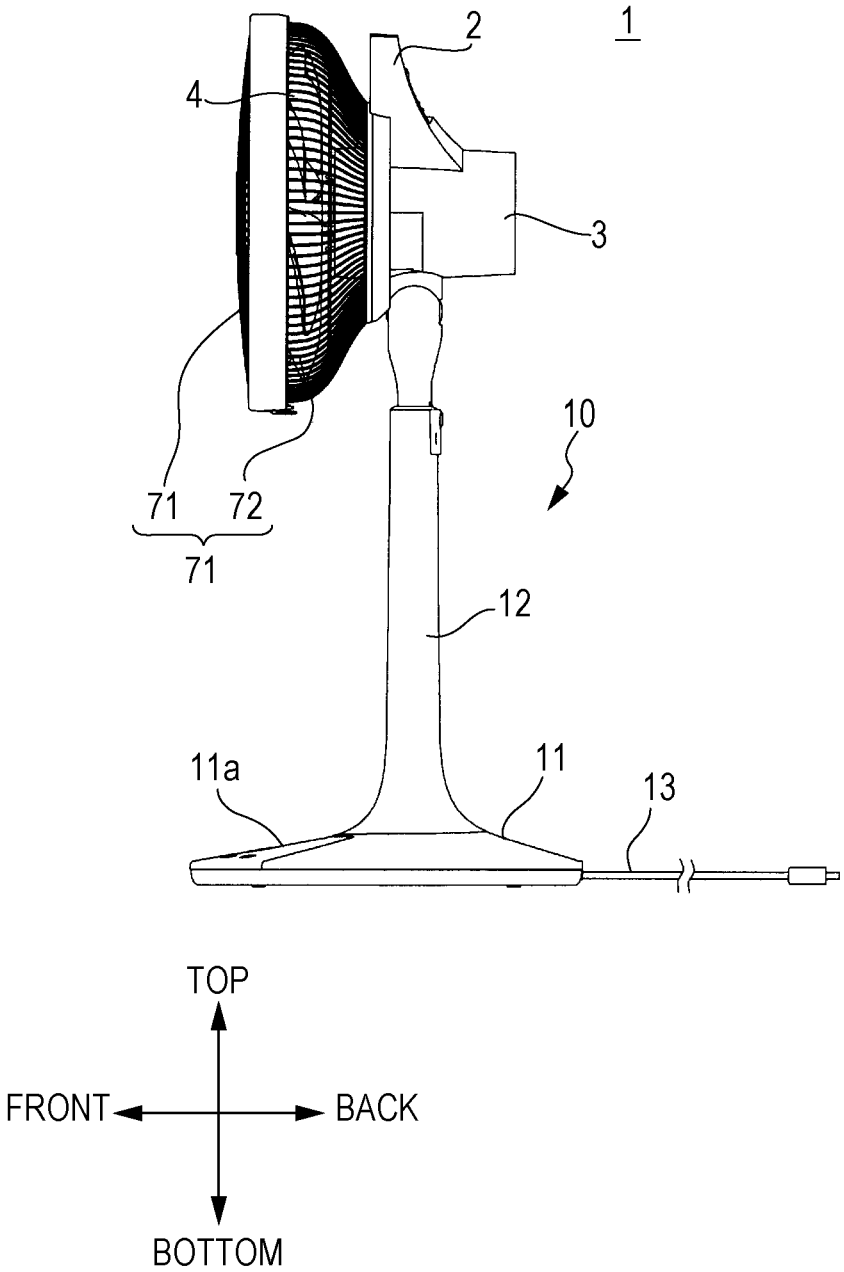
FIG. 3 is a side view of the electric fan according to the embodiment.

Hereinafter, the present invention will be described in detail based on the drawings depicting an embodiment thereof by taking up, as an example, an electric fan as an air blowing device. FIG. 1 is a perspective view depicting the front-side appearance of an electric fan 1 according to the embodiment, FIG. 2 is a perspective view depicting the back-side appearance of the electric fan 1 according to the embodiment, and FIG. 3 is a side view of the electric fan 1 according to the embodiment. In the following description, top and bottom, right and left, and front and back indicated in the drawings by arrows will be used.

The electric fan 1 is formed of an electric fan main body (an air blowing device main body) 10, a power cord 13, an unillustrated remote controller, and so forth. The electric fan main body 10 includes a base 11, a supporting column 12, a motor housing portion 3, a fan (an impeller) 4, a fan cover (an impeller cover) 7, a handle portion 2, an ion generator 9 (an electrically-charged particle generator, see FIG. 4), and so forth. The base 11 is disk-shaped and is placed on a floor surface. On an upper front side of the base 11, an operation panel 11*a* provided with various operation keys used by the user to operate the electric fan 1 is provided, and a supporting column 12 is provided in a standing manner in a central position nearer the back. The fan 4, the fan cover 7, the handle portion 2, and so forth are attached to the motor housing portion 3. The electric fan main body 10 has the motor housing portion 3 coupled to an upper part of the supporting column 12 provided in a standing manner in the base 11. The power cord 13 has a power plug that can be inserted into and pulled out of a commercial power receptacle. Incidentally, a structure may be adopted in which a DC-input receptacle is provided at the outer edge of the base 11 and the power cord 13 includes a plug that can be inserted into and pulled out of the receptacle and an AC adaptor, whereby the alternating current from the commercial power supply is converted into a direct current and is then supplied to the electric fan main body 10.

Figure 4:
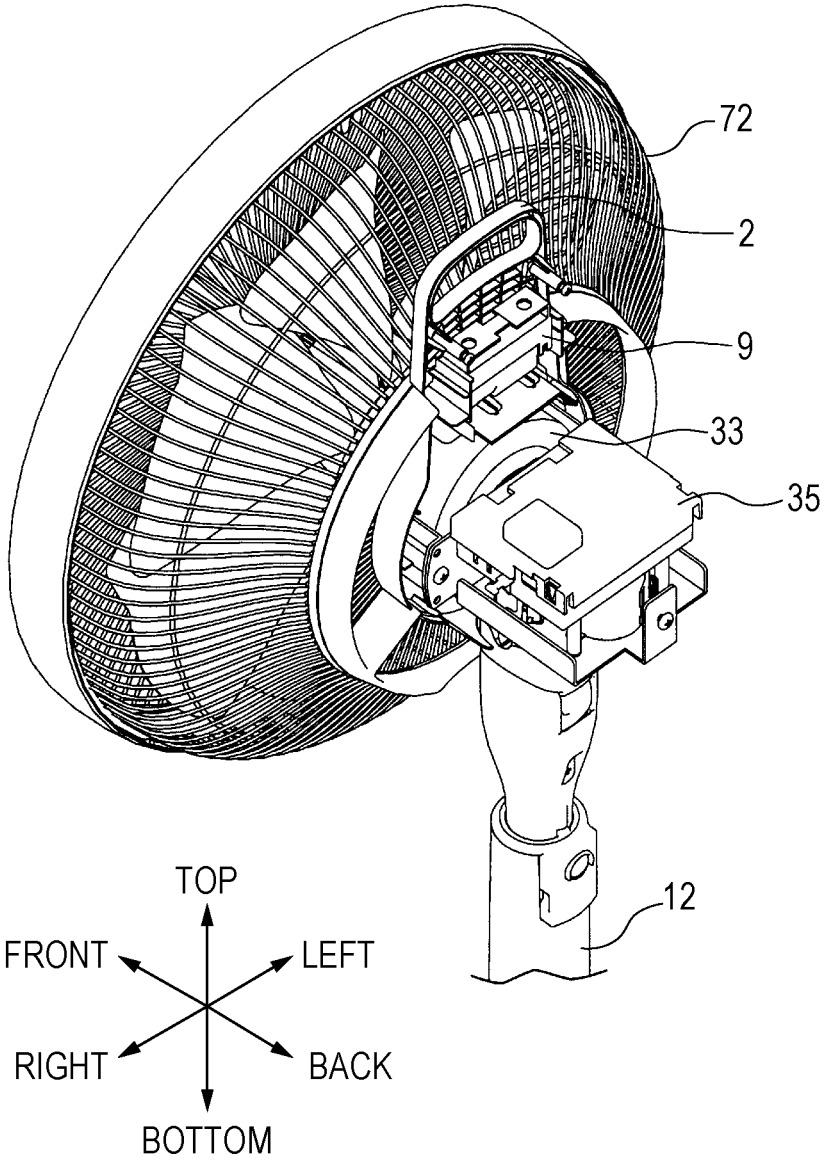
FIG. 4 is a perspective view from a back side, the perspective view depicting the inside of a motor housing portion.
Figure 5:
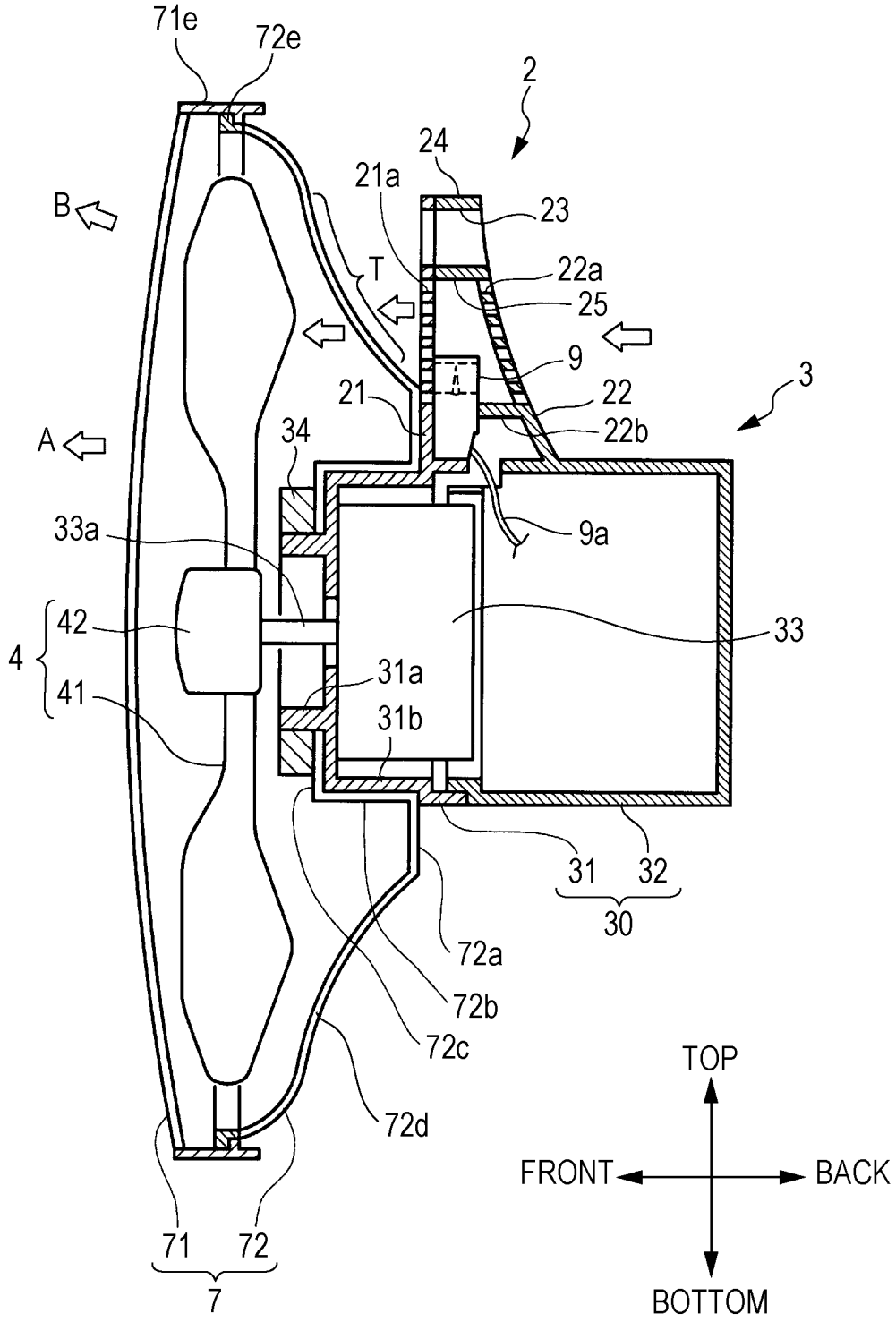
FIG. 5 is a schematic side sectional view of an area around the motor housing portion.

FIG. 4 is a perspective view from a back side, the perspective view depicting the inside of the motor housing portion 3, and FIG. 5 is a schematic side sectional view of an area around the motor housing portion 3. The motor housing portion 3 includes a motor 33 having a substantially cylindrical shape, a casing 30 housing the motor 33, and so forth. The motor 33 has an output shaft 33*a* protruding from one side, and the fan 4 is attached to the tip of the output shaft 33*a*. In the casing 30, in addition to the motor 33, a relay circuit portion 35 that relays an electric power line and a control signal line to the motor 33 and so forth is disposed. The casing 30 has the shape of a closed-end cylinder whose axial direction coincides with the direction of an axis of the output shaft 33*a*, and the handle portion 2 is formed on top thereof. The casing 30 is formed of a casing front separate body 31 and a casing rear separate body 32 which overlap in an intermediate portion in an axial direction.

The casing front separate body 31 has the shape of a cylinder having a bottom on the front side. In a front-side bottom portion of the casing front separate body 31, a fit cylinder 31*a* is provided with the same center shared with the output shaft 33*a*. At the outer periphery of the fit cylinder 31*a*, an external thread is formed and threadably engaged with an internal thread formed at the inner periphery of a nut 34. In an upper part of the outer periphery of the casing front separate body 31, a handle portion front separate body 21, which will be described later, is integrally formed. To the front-side bottom portion of the casing front separate body 31, the motor 33 is secured by screws, and the front end of the casing rear separate body 32 is fitted into the rear end of the casing front separate body 31 and the casing rear separate body 32 is secured thereto by screws. Therefore, by unscrewing the screws, the casing rear separate body 32 fitted into the casing front separate body 31 is removed, and the motor 33 is exposed.

The casing rear separate body 32 has the shape of a cylinder having a bottom on the rear side, and, in an upper part of the outer periphery thereof, a handle portion rear separate body 22, which will be described later, is integrally formed. Incidentally, the shape of the casing 30 is not limited to the above-described closed-end cylindrical shape and may be the shape of a closed-end rectangular tube. Moreover, the axial direction of the cylindrical casing 30 may be an axial direction intersecting with the output shaft 33*a*, and, in this case, the handle portion 2 may be provided in a standing manner on an upper outer surface of the casing 30 in an intermediate portion of the output shaft 33*a* in the direction of an axis thereof.

The fan 4 is a propeller fan provided with a cylindrical boss portion 42 fixed to the output shaft 33*a* of the motor 33, a plurality of vanes 41 provided in the boss portion 42 equidistantly in a circumferential direction, and so forth. The fan 4 integrally rotates with the rotation of the output shaft 33*a* of the motor 33. The fan 4 is provided with a breathable fan cover 7 covering the fan 4. The fan cover 7 includes a fan cover front separate body 71 that covers the fan 4 from the front side to an outer edge portion thereof and a fan cover rear separate body 72 that covers the fan 4 from the rear side to the outer edge portion thereof and is fitted into the fan cover front separate body 71.

The fan cover rear separate body 72 has the shape of a dish and has formed therein a cylindrical fitting portion 72*b* protruding from an annular bottom portion 72*a*. The fitting portion 72*b* shares the axis with the output shaft 33*a*, the inner periphery of the fitting portion 72*b* is fitted into the outer periphery of the front-side end 31*b* of the casing front separate body 31, and this fit defines the radial position of the fan cover rear separate body 72. Moreover, an annular flange 72*c* is provided at the front-side end of the fitting portion 72*b*. By being clamped by the nut 34, the fan cover rear separate body 72 is fixed in a state in which the flange 72*c* is sandwiched between the nut 34 and the front-side bottom portion of the casing front separate body 31.

A side face portion 72*d* of the fan cover rear separate body 72 has the shape of a cone with a wider front side, stretches from an outer edge of the bottom portion 72*a* to an outer ring 72*e*, and covers a rear side portion and the outer edge portion of the fan 4. An edge line of the side face portion 72*d* describes an inward projection on the side where the bottom portion 72*a* is located, describes an outward projection on the side where the outer ring 72*e* is located, and describes a smoothly-connected curve in an intermediate area. The fan cover rear separate body 72 has a tapered part T facing the handle portion 2, which will be described later, and, in the tapered part T, an outer peripheral side is tilted toward the fan 4. Incidentally, the fan cover front separate body 71 is locked as a result of an outer ring 71*e* being fitted into the outer ring 72*e* of the fan cover rear separate body 72 and covers a front-side portion of the fan 4.

The handle portion 2 has the shape of a hollow truncated pyramid and has a through hole 23 (a hand insertion hole) formed at the tip thereof, and an upper edge portion of the through hole 23 forms a handle 24. It is preferable that the handle 24 is formed to have the shape and size that allow the user to grasp the handle 24 easily, and, in this embodiment, the front and back width is set at about 10 to 30 mm, the right and left width is set at about 80 to 100 mm, and the height is set at about 5 to 15 mm. Moreover, the through hole 23 is configured such that the height of an opening is set at about 15 to 30 mm and the right and left width is set at about 80 to 100 mm in order to allow the user to insert the hand thereinto easily. Furthermore, in an intermediate portion of the handle portion 2, a passage 25 passing it completely through in a front-back direction is formed. Incidentally, specifically, the above-described tapered part T of the fan cover rear separate body 72 faces the handle portion 2 from the intermediate portion thereof (a vertical central part nearer a lower side) to the handle 24 at the tip thereof. In addition, the handle portion 2 may be configured to be in contact with an outer surface of the bottom portion 72*a* of the fan cover rear separate body 72 in a front face of a base end portion.

The handle portion 2 is formed of the handle portion front separate body 21 formed integrally with the casing front separate body 31 and the handle portion rear separate body 22 formed integrally with the casing rear separate body 32. The handle portion front separate body 21 has the shape of a rectangular plate and forms a front wall of the handle portion 2. The handle portion front separate body 21 is disposed in a position nearer the rear end of the casing front separate body 31 and, when the casing 30 is viewed as a whole, is disposed in a position slightly nearer the front in the intermediate portion in the axial direction. The handle portion rear separate body 22 has the shape of a hollow truncated pyramid and forms a rear side wall, right and left side walls, and upper left side walls of the handle portion 2. As described earlier, when the front end of the casing rear separate body 32 is fitted into the rear end of the casing front separate body 31, the front edges of the right and left side walls and the upper left side wall formed by the handle portion rear separate body 22 overlap the outer edge of the handle portion front separate body 21. The handle 24 is formed as a result of the upper edge of the through hole 23 formed in the handle portion rear separate body 22 overlapping and integrating with the upper edge of the through hole 23 formed in the handle portion front separate body 21.

In a front opening of the passage 25, a front cover portion 21*a* (a cover) is formed, and, in a rear opening, a rear cover portion 22*a* (a cover) is formed. The front cover portion 21*a* has a plurality of vertical bridges and horizontal bridges, and air holes are formed between the bridges. The rear cover portion 22*a* has a plurality of horizontal bridges, and, as is the case with the front cover portion 21*a*, air holes are formed between the bridges. The front cover portion 21*a* and the rear cover portion 22*a* are configured such that a finger cannot be inserted into the passage 25 by setting the intervals between the bridges at about 5 mm. Incidentally, the placement of the bridges and the intervals between the bridges are not limited to those described above.

The handle portion 2 has the ion generator 9 attached to the inside thereof. The ion generator 9 is sandwiched between an inner wall surface of the handle portion front separate body 21 on the side where a base end is located and a front end face of a lower side wall 22*b* of the passage 25 formed in the handle portion rear separate body 22. The ion generator 9 is disposed in such a way that an electrode portion, which will be described later, is exposed in the passage 25. Moreover, a cable 9*a* that supplies electric power and a control signal to the ion generator 9 is connected to the relay circuit portion 35 in the casing 30 from the inside of the base end portion of the handle portion 2.

The handle portion 2 is disposed in a lateral nearly-barycentric position of the electric fan main body 10. Specifically, the front-back barycentric position of the electric fan main body 10 is situated somewhat in front of the supporting column 12, and the handle portion 2 is located vertically above this front-back barycentric position. Furthermore, the horizontal barycentric position is located nearly above the output shaft 33*a* of the motor 33, and the handle portion 2 is formed symmetrically in a vertical plane including the output shaft 33*a*.

Figure 6:
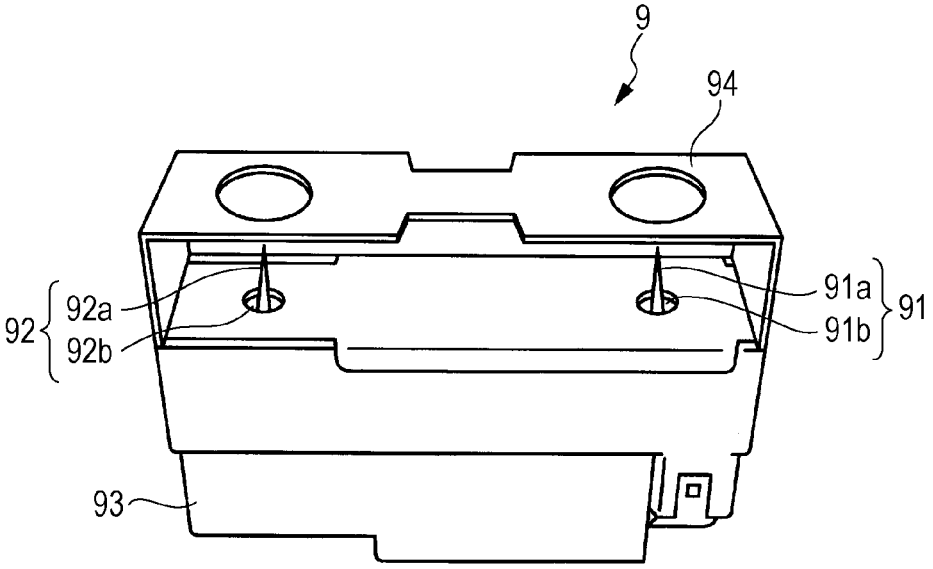
FIG. 6 is an external perspective view of an ion generator.

FIG. 6 is an external perspective view of the ion generator 9. The ion generator 9 includes electrode portions 91 and 92, an ion generator main body 93, and an electrode cover 94. The ion generator main body 93 is a box-shaped object formed as a substantially rectangular parallelepiped and has a built-in electric circuit. The electrode portion 91 includes a needle-like discharge electrode 91*a* and an induction electrode 91*b* facing the discharge electrode 91*a*, and, likewise, the electrode portion 92 also includes a needle-like discharge electrode 92*a* and an induction electrode 92*b* facing the discharge electrode 92*a*. The electrode portions 91 and 92 respectively have the discharge electrodes 91*a* and 92*a*, each being provided in a corresponding one of two through holes provided on one side face of the ion generator main body 93 in such a way as to share the center of the corresponding through hole. The electrode cover 94 has the shape of a rectangular plate, is attached to the ion generator main body 93 by bending the longitudinal ends, and covers the tips of the needle-like discharge electrodes 91*a* and 92*a*. Between the discharge electrode 91*a* and the induction electrode 91*b* and between the discharge electrode 92*a* and the induction electrode 92*b*, a high voltage is applied by the built-in electric circuit of the ion generator main body 93.

Figure 7:
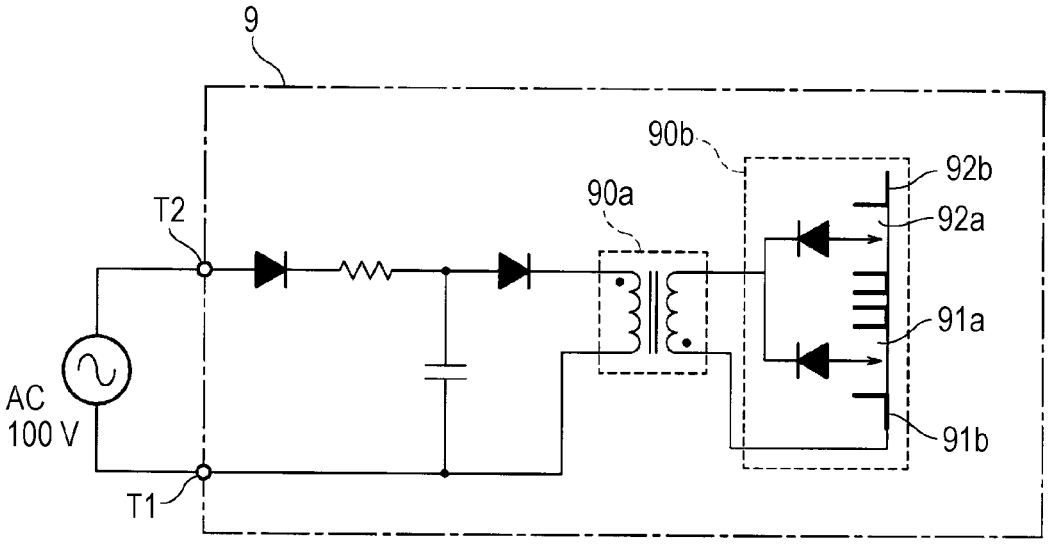
FIG. 7 is an electric diagram of the ion generator.

FIG. 7 is an electric diagram of the ion generator 9. The ion generator 9 includes a voltage raising circuit 90*a* that raises an applied voltage between the terminal T1 and the terminal T2 to which an alternating-current voltage of 100 V is supplied and a voltage application circuit 90*b* that applies the voltage raised by the voltage raising circuit 90*a* to the electrode portions 91 and 92. The electric circuit of the ion generator 9 is configured such that discharge is produced between the electrodes by applying the high voltage raised by the voltage raising circuit 90*a* between the discharge electrode 91*a* and the induction electrode 91*b* and between the discharge electrode 92*a* and the induction electrode 92*b* by the voltage application circuit 90*b*.

In the electrode portions 91 and 92, by ionizing water in the air by discharge, H+ (H2O)m (m is an arbitrary natural number) as positive ions and O2− (H2O)n (n is an arbitrary natural number) as negative ions are generated. When both ions are released into the air, these ions adhere to the surfaces of the floating bacteria and airborne viruses in the air. Then, as a result of them reacting chemically with each other, hydrogen peroxide (H2O2) and/or a hydroxyl radical (.OH) which are activated species are generated, which makes it possible to kill or inactivate the floating bacteria, the airborne viruses, or the like in the air.

As described earlier, the ion generator 9 is sandwiched between the inner wall surface of the handle portion front separate body 21 on the side where the base end is located and the front end face of the lower side wall 22*b* of the passage 25 formed in the handle portion rear separate body 22. Since the high voltage is applied to the discharge electrodes 91*a* and 92*a* of the ion generator 9, a predetermined distance is required between them and a portion forming an outer shell for safe handling. Specifically, since the rear side wall of the handle portion rear separate body 22 is gradually inclined toward the fan 4, although the intermediate portion of the rear cover portion 22*a* and the intermediate portion of the front cover portion 21*a* are located in positions closest to the discharge electrodes 91*a* and 92*a*, the front side does not pose any problem because the fan cover rear separate body 72 is located in front of the intermediate portion of the front cover portion 21*a*. According to this embodiment, with consideration given to a safety distance required for high-voltage equipment, the distance between the discharge electrodes 91*a* and 92*a* and the rear face of the intermediate portion of the rear cover portion 22*a* is set at 30 mm or more. For the sake of safety, the greater this distance, the better, but an unnecessary great distance causes enlargement of the handle portion, resulting in enlargement of the electric fan 1 itself and making it difficult to handle the electric fan 1 easily; therefore, it is preferable to determine the distance so that the distance does not become too great based on the safety standards or the like of an industrial association.

The discharge electrodes 91*a* and 92*a* do not pose safety problems because, as for directions other than the directions in which the front cover portion 21*a* and the rear cover portion 22*a* are located, the discharge electrodes 91*a* and 92*a* are covered due to the presence of an upper wall of the passage 25 located above the discharge electrodes 91*a* and 92*a* and the casing front separate body 31 and the casing rear separate body 32 located below the discharge electrodes 91*a* and 92*a*.

However, the motor 33 is located below the ion generator 9, which may cause the ions generated in the ion generator 9 to be absorbed by a metal portion forming the motor 33; therefore, it is preferable to dispose a partition place between the ion generator 9 and the motor 33.

Figure 8:
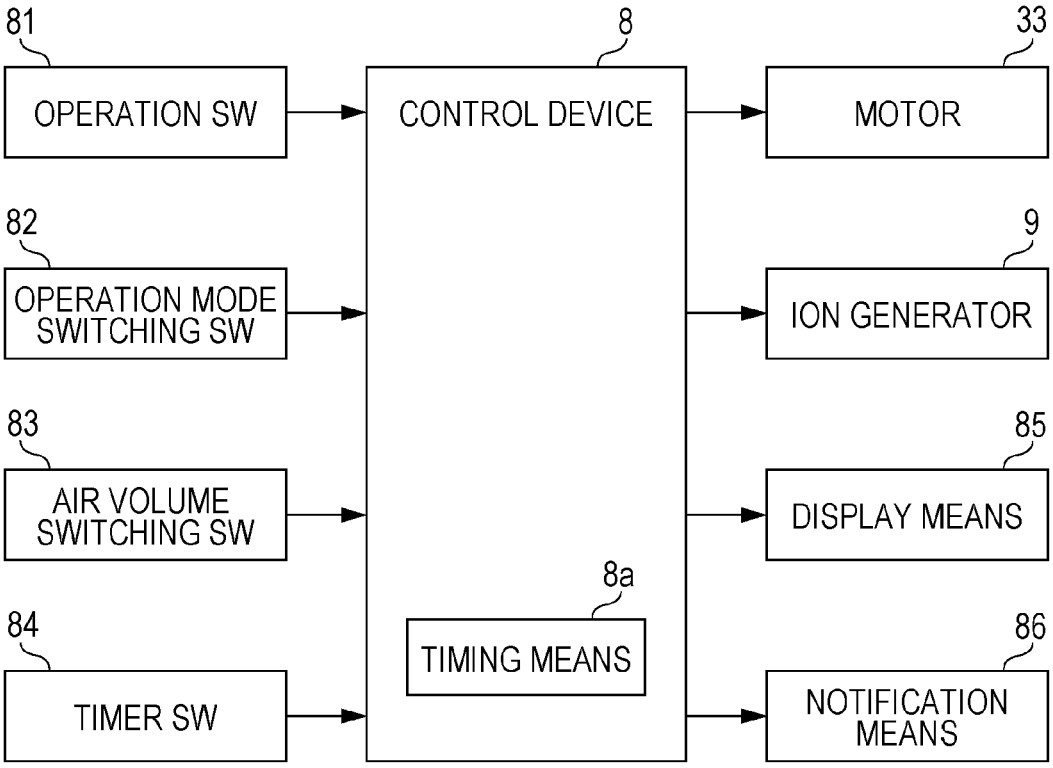
FIG. 8 is a block diagram depicting a control system of the electric fan.

FIG. 8 is a block diagram depicting a control system of the electric fan 1. The base 11 incorporates a control device 8 using a microcomputer or the like and controls the operation of the electric fan 1. In the operation panel 11*a* provided in the base 11, an operation switch (hereinafter an operation SW) 81 that turns on and off the electric fan 1, an operation mode switching switch (hereinafter an operation mode switching SW) 82 that chooses whether operation of the ion generator 9 is required or not, an air volume switching switch (hereinafter an air volume switching SW) 83 that selects the volume of air, and a timer switch (hereinafter a timer SW) 84 that selects timer operation are provided, and the operation panel 11*a* accepts an operation signal input by the user by using the switches and provides the signal to the control device 8. Moreover, in the operation panel 11*a*, a display means 85 that displays the operation result and a notification means 86 that notifies the user of the operation result are provided.

In the electric fan 1 configured as described above, when the operation SW 81 is turned on, the electric power is supplied to the motor 33 and the output shaft 33*a* of the motor 33 rotates. With the rotation of the output shaft 33*a*, the fan 4 fixed to the output shaft 33*a* rotates, sucks in the air through the fan cover rear separate body 72, and blows out the air through the fan cover front separate body 71, whereby air blowing operation is performed. As a result of the air volume switching SW 83 being pressed, the control device 8 performs control by which the number of revolutions of the motor 33 is switched, and, for example, the volume of air is switched as follows: "strong wind", "cool wind", and "weak wind". Moreover, as a result of the timer SW 84 being pressed, the control device 8 starts timing by a timing means 8*a* to stop the operation after a lapse of a predetermined time and stops the air blowing operation when the predetermined time has elapsed.

Furthermore, when ion generation operation is selected by the operation mode switching SW 82, the electric power is also supplied to the ion generator 9, and the positive and negative ions are generated. The generated positive and negative ions are released into the passage 25, sent toward the fan 4 by an airflow (an airflow toward the front from behind) generated in the passage 25 by the rotation of the fan 4, sucked in through the fan cover rear separate body 72, blown toward the front through the fan cover front separate body 71, and dispersed in the space in front of the electric fan 1.

In this embodiment, as a vane of the electric fan, a so-called propeller fan is used. The propeller fan produces a spiral airflow with the rotation axis of the fan 4 located at the center thereof in accordance with the number of vanes forming the propeller fan. The spiral airflow has the property of flowing downstream while rotating about the rotation axis of the fan 4 and traveling outward in a radial direction while dispersing the air.

As a result, as indicated by arrow outlines with blanks inside of FIG. 5, the ions generated by the ion generator 9 are sucked in by the fan 4 in the airflow passing through the passage 25 toward the front from behind and are then separated into ions that travel forward in a nearly straight line by an airflow A in an area near the rotation axis of the fan 4 and ions that disperse in the room by an airflow B in an area away from the rotation axis.

The user who operates the electric fan 1 from the front side thereof is, as a matter of course, in front of the electric fan 1. In order to adjust the amount of ions to be directly sent to the user who is in front of the electric fan 1 and the amount of ions that are widely dispersed in the room to improve the indoor condition to achieve desired balance, in this embodiment, the radial positions of the discharge electrodes 91*a* and 92*a* of the ion generator 9 (the positions where ions are generated) are set so as to coincide with a position corresponding to half the radial length of the vane 41 of the fan 4 (a position which is roughly intermediate between the base end portion and the tip). Incidentally, the radial positions of the discharge electrodes 91*a* and 92*a* of the ion generator 9 may be appropriately determined based on an airflow that is generated by the vane 41 and are not limited to the positions described above.

As a result of the positive and negative ions being dispersed in the space in front of the electric fan 1, the positive and negative ions kill or inactivate viruses such as influenza viruses and pathogens floating in the air and reduce the number of viruses and pathogens. Moreover, in this embodiment, although the ion generator 9 is configured to generate positive and negative ions, the ion generator 9 may be an ion generator that generates only negative ions. In this case, it has been assumed that it is possible to feel cool air and, at the same time, obtain the useful physiological effect such as refreshing feeling by the negative ions.

Moreover, the user can carry the electric fan 1 by lifting the electric fan 1 by inserting the fingertip into the handle 24 of the electric fan 1 in a state, for example, in which the air blowing operation is stopped. Since the handle portion 2 is formed in a lateral (front-back and horizontal) nearly-barycentric position, the electric fan 1 is lifted in almost the same position thereof as the position in which the electric fan 1 is placed on the floor surface. Even when the electric fan 1 is swayed in a front-back direction at the time of transportation, the handle 24 is large enough to allow the user to grasp it firmly in his/her hand.

As described above, according to this embodiment, the fan 4 coupled to the output shaft 33*a* of the motor 33 is rotated by the motor 33 to send air. The motor 33 is housed in the motor housing portion 3, and the fan cover rear separate body 72 in the shape of a flange, the fan cover rear separate body 72 covering the outer edge portion of the fan 4 and the lateral part of the fan 4 on the side where the motor 33 is located, is fixed to the end of the motor housing portion 3 on the side where the output shaft 33*a* is located. The handle portion 2 is provided in a standing manner in the intermediate portion of the output shaft 33*a* in the direction of an axis thereof on the outer surface of the motor housing portion 3. Since the fan cover rear separate body 72 has the tapered portion T which faces the handle portion 2 and whose outer peripheral side is inclined toward the fan 4, an adequate space between the handle portion 2 and the fan cover rear separate body 72 is secured, which makes it easy to hold the handle portion 2 and carry the electric fan 1 and makes it possible to enhance the convenience.

Moreover, according to this embodiment, the fan cover rear separate body 72 has the cylindrical fitting portion 72*b* that fits into the outer periphery of the front-side end 31*b* of the casing front separate body 31 of the motor housing portion 3. As a result, when the fan cover rear separate body 72 is attached to the motor housing portion 3, by fitting the fitting portion 72*b* into the outer periphery of the front-side end 31*b* of the casing front separate body 31, the radial position is determined, which facilitates assembly.

Furthermore, according to this embodiment, the fan cover rear separate body 72 may be in touch with the handle portion 2; in this case, since the fan cover rear separate body 72 is biased and supported by the handle portion 2, the shake of the fan cover 7 caused by the vibration which is generated when the fan 4 is rotated by the motor 33 is suppressed.

In addition, according to this embodiment, the handle portion 2 has, in the intermediate portion, the passage 25 that allows the air to pass therethrough, and the positive and negative ions which are released into the passage 25 are generated by the ion generator 9. The positive and negative ions are sucked in by the fan 4 with the air passing through the passage 25 and are blown out therefrom. The air is purified by the positive and negative ions blown out from the fan 4.

Moreover, according to this embodiment, the handle portion 2 is formed integrally with the casing 30 of the motor housing portion 3. Specifically, the handle portion 2 is formed of the handle portion front separate body 21 formed integrally with the casing front separate body 31 and the handle portion rear separate body 22 formed integrally with the casing rear separate body 32. As a result, the coupling between the handle portion 2 and the casing 30 is strengthened and the number of parts and the number of assembly processes are reduced, which facilitates production.

Furthermore, according to this embodiment, the electric fan main body 10 is configured with the motor housing portion 3 coupled to an upper part of the supporting column 12 that is provided in a standing manner in the base 11 to be placed on the floor surface, and the handle portion 2 is disposed in a lateral (front-back and horizontal) nearly-barycentric position of the electric fan main body 10. As a result, when a state in which the electric fan main body 10 is put on the floor surface is changed to a state in which the electric fan main body 10 is lifted with the handle portion 2 being grasped, the position of the electric fan main body 10 is not changed, which makes it easy to carry the electric fan main body 10.

In addition, according to this embodiment, the handle portion 2 is provided in a standing manner on the outer surface of the motor housing portion 3. The passage 25 that allows the air to pass therethrough is provided in the intermediate portion of the handle portion 2, and the ion generator 9 that generates positive and negative ions to be released into the passage 25 is provided in the handle portion 2 in the base end portion thereof. This makes it possible to prevent the ion generator 9 from being touched from outside and ensure safety. Moreover, the handle portion 2 is located behind the fan 4 and has little effect on the blowing function of sending air forward. Furthermore, since the heat generated in the ion generator 9 rises and is exhausted by the air flowing through the passage 25, it is possible to suppress an increase in the temperature of the ion generator 9. In addition, since the cable 9*a* that supplies electric power and a control signal to the ion generator 9 is connected to the relay circuit portion 35 in the casing 30 from the inside of the base end portion of the handle portion 2, it is possible to simplify the cable wiring of the ion generator 9.

Moreover, according to this embodiment, the front cover portion 21*a* and the rear cover portion 22*a* are disposed in the openings of the passage 25, and the ion generator 9 includes the discharge electrodes 91*a* and 92*a* exposed in the passage 25 and the induction electrodes 91*b* and 92*b* which face the discharge electrodes 91*a* and 92*a* and to which a high voltage is applied between the induction electrodes 91*b* and 92*b* and the discharge electrodes 91*a* and 92*a*. Since the discharge electrodes 91*a* and 92*a* are exposed in the passage 25, the positive and negative ions generated near the discharge electrodes 91*a* and 92*a* are easily carried by the airflow in the passage 25, which makes it possible to disperse the positive and negative ions more effectively. Since the front cover portion 21*a* and the rear cover portion 22*a* are disposed in the openings of the passage 25, even when the discharge electrodes 91*a* and 92*a*, to which a high voltage is applied between the discharge electrodes 91*a* and 92*a* and the induction electrodes 91*b* and 92*b*, are exposed in the passage 25, it is possible to prevent the discharge electrodes 91*a* and 92*a* from being touched from outside.

Furthermore, according to this embodiment, the handle portion 2 is formed of two separate bodies that overlap in the intermediate portion of the output shaft 33*a* in the direction of an axis thereof. Specifically, the handle portion 2 is formed of the handle portion front separate body 21 formed integrally with the casing front separate body 31 and the handle portion rear separate body 22 formed integrally with the casing rear separate body 32. Since the ion generator 9 is sandwiched between the inner wall surface of the handle portion front separate body 21 on the side where the base end is located and the front end face of the lower side wall 22*b* of the passage 25 formed in the handle portion rear separate body 22, it is easy to attach the ion generator 9.

In addition, according to this embodiment, since the motor housing portion 3 has the shape of a cylinder whose axial direction coincides with the direction of an axis of the output shaft 33*a* of the motor 33, the airflow of the electric fan 1 is stabilized.

Moreover, according to this embodiment, since the passage 25 passes through the handle portion 2 in the direction of an axis of the output shaft 33*a* of the motor 33, the positive and negative ions generated by the ion generator 9 are easily carried by the airflow in the passage 25.

Furthermore, according to this embodiment, since the handle portion 2 has, at the tip thereof, the horizontally long through hole 23 (the hand insertion hole) passing through the output shaft 33*a* of the motor 33 in the direction of an axis thereof, it becomes easy to carry it.

In this embodiment, although a mode in which ions produced as a result of water molecules being flocculated are generated as electrically-charged particles has been described, the mode is not limited to this mode, and a mode may be adopted in which the air blowing device generates electrically-charged particles such as electrically-charged water particles.

Incidentally, it is to be understood that the present invention is not limited to this embodiment and covers the technical scope of the invention described in the claims and an equivalent scope thereof.

REFERENCE SIGNS LIST

1 electric fan (air blowing device)
10 electric fan main body (air blowing device main body)
11 base
12 supporting column
2 handle portion
21*a* front cover portion (cover)
22*a* rear cover portion (cover)
23 through hole (hand insertion hole)
25 passage
3 motor housing portion
33 motor
33*a* output shaft
4 fan (impeller)
7 fan cover (impeller cover)
9 ion generator (electrically-charged particle generator)
91*a*, 92*a* discharge electrode
91*b*, 92*b* induction electrode

The invention claimed is:

1. An air blowing device that sends air by an impeller coupled to an output shaft of a motor, the air blowing device comprising:

a motor housing portion that houses the motor;

an impeller cover that is fixed to the motor housing portion and has a shape of a flange, the impeller cover covering an outer edge portion of the impeller and a lateral part of the impeller on a side where the motor is located; and a handle portion that is provided in a standing manner in an intermediate portion on an outer surface of the motor housing portion in the output shaft direction, wherein the impeller cover has a tapered portion which faces the handle portion and whose outer peripheral side is inclined toward the impeller.

2. The air blowing device according to claim 1, wherein the impeller cover has a fitting portion fitting into the motor housing portion.

3. The air blowing device according to claim 2, wherein the impeller cover is in contact with the handle portion.

4. The air blowing device according to claim 1, wherein the handle portion has, in an intermediate portion, a passage that allows air to pass therethrough, and the air blowing device includes an electrically-charged particle generator that generates electrically-charged particles which are released into the passage.

5. The air blowing device according to claim 4, wherein a breathable cover is disposed in an opening of the passage, and the electrically-charged particle generator has a discharge electrode exposed in the passage and an induction electrode which faces the discharge electrode and to which a high voltage is applied between the induction electrode and the discharge electrode.

6. The air blowing device according to claim 4, wherein the handle portion is formed of two separate bodies that overlap in an intermediate portion in the output shaft direction, and the electrically-charged particle generator is sandwiched between the two separate bodies.

7. The air blowing device according to claim 1, wherein the handle portion is formed integrally with the motor housing portion.

8. The air blowing device according to claim 1, wherein the handle portion is disposed in a lateral nearly-barycentric position of an air blowing device main body with the motor housing portion coupled to an upper part of a supporting column provided in a standing manner in a base to be placed on a floor surface.

9. The air blowing device according to claim 1, wherein the handle portion has, at a tip thereof, a horizontally long hand insertion hole passing through the handle portion in the direction of an axis of the output shaft.

10. An air blowing device that sends air by an impeller coupled to an output shaft of a motor, the air blowing device comprising:

a motor housing portion that houses the motor;

a handle portion provided in a standing manner on an outer surface of the motor housing portion, the handle portion having, in an intermediate portion, a passage that allows air to pass therethrough; and an electrically-charged particle generator that is provided in the handle portion in the base end portion thereof and generates electrically-charged particles which are released into the passage.

11. The air blowing device according to claim 10, wherein a breathable cover is disposed in an opening of the passage, and the electrically-charged particle generator has a discharge electrode exposed in the passage and an induction electrode which faces the discharge electrode and to which a high voltage is applied between the induction electrode and the discharge electrode.

12. The air blowing device according to claim 10, wherein the handle portion is formed of two separate bodies that overlap in an intermediate portion in the output shaft direction, and the electrically-charged particle generator is sandwiched between the two separate bodies.

13. The air blowing device according to claim 10, wherein the motor housing portion has a shape of a cylinder whose axial direction coincides with a direction of an axis of the output shaft.

14. The air blowing device according to claim 10, wherein the passage is provided in such a way as to pass through the handle portion in the direction of an axis of the output shaft.

* * * * *